US006508068B2

(12) United States Patent
Ohkawara

(10) Patent No.: US 6,508,068 B2
(45) Date of Patent: Jan. 21, 2003

(54) CHILLING SYSTEM

(75) Inventor: Yoshio Ohkawara, Yokohama (JP)

(73) Assignee: Innotech Corporation, Yokohama (JP)

( * ) Notice: Subject to any disclaimer, the term of this patent is extended or adjusted under 35 U.S.C. 154(b) by 7 days.

(21) Appl. No.: 09/997,112

(22) Filed: Nov. 29, 2001

(65) Prior Publication Data

US 2002/0066280 A1 Jun. 6, 2002

(30) Foreign Application Priority Data

Dec. 6, 2000 (JP) ..... 2000-370973

(51) Int. Cl.[7] ..... F25D 17/02

(52) U.S. Cl. ..... 62/185; 62/434; 62/DIG. 22; 165/45

(58) Field of Search ..... 62/185, 434, DIG. 22; 165/45

(56) References Cited

U.S. PATENT DOCUMENTS 3,276,516 A * 10/1966 Japhet ..... 165/221
4,457,358 A * 7/1984 Kriege et al. ..... 165/50
5,727,621 A * 3/1998 Hardin ..... 165/45
6,148,626 A * 11/2000 Iwamoto ..... 165/236

* cited by examiner

*Primary Examiner*—William C. Doerrler
*Assistant Examiner*—Filip Zec
(74) *Attorney, Agent, or Firm*—Steinberg & Raskin, P.C.

(57) ABSTRACT

Provision of a chilling system accomplishing a reduction in the amount of energy expended and in energy loss. The chilling system includes a load (H); a chilling circuit (A) for chilling or cooling the load with a refrigerant; a heat-dissipating mechanism (5) for dissipating heat of the refrigerant in the chilling circuit (A) to the outside; a refrigerant tank (8) connected to the chilling circuit (A) via a confluent valve (13); a chiller for maintaining the refrigerant stored in the refrigerant tank (8) at a predetermined temperature; a controller (12) for controlling the degree of valve opening of the confluent valve (13); and a temperature sensor (14) for detecting a temperature of the refrigerant in the chilling circuit (A). When the temperature sensor (14) detects that a temperature of the refrigerant in the chilling circuit (A) exceeds a predetermined temperature, the controller (12) opens the confluent valve (13) in order to mix the refrigerant in the refrigerant tank (8) with that in the chilling circuit (A). When the refrigerant stored in the refrigerant tank (8) is maintained at a temperature within a predetermined range, the chiller (11) stops its operation.

2 Claims, 3 Drawing Sheets

*Fig. 3* *Prior Art*
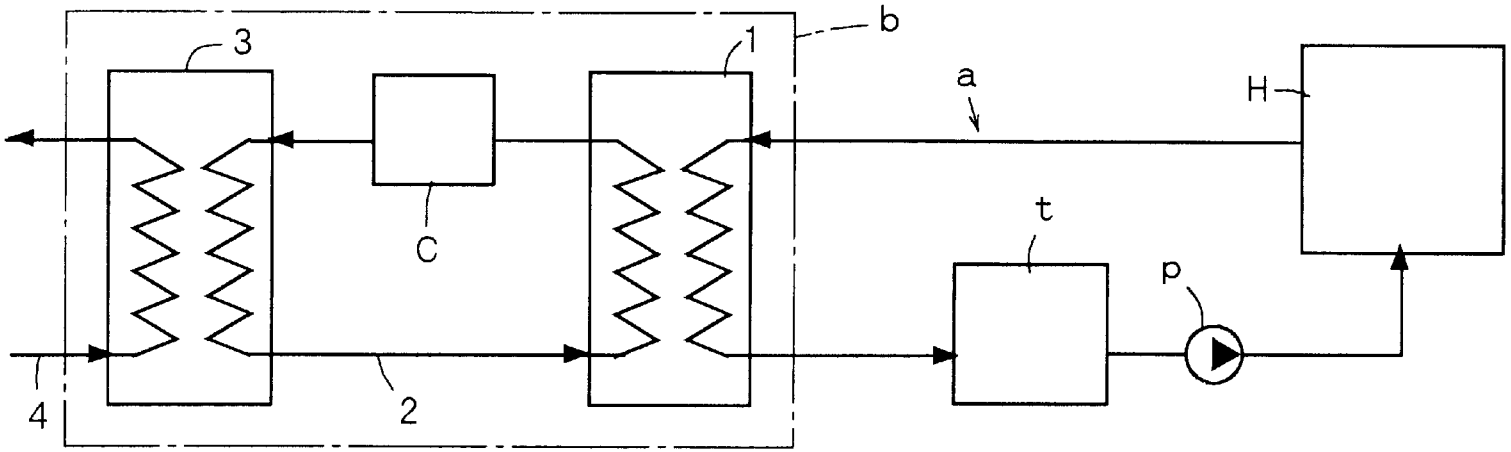

CHILLING SYSTEM

BACKGROUND OF THE INVENTION

1. Field of the Invention

This invention relates to a chilling system using a refrigerant to chill or cool a load.

2. Description of the Invention

A conventional system illustrated in FIG. 3 includes a chilling circuit a which is connected to a heat-producing load H.

The chilling circuit a includes a pump p for circulating a secondary cooling water through the circuit a, and a buffer tank t for temporarily storing the secondary cooling water. Heat exchanging is implemented during a process in which the secondary cooling water is passed through the load H to absorb heat generated by the load H.

Due to the absorption of heat generated by the load H as described above, the secondary cooling water increases in temperature. However, the heat of the secondary cooling water is dissipated by a chiller b as described below.

The chiller b is composed of a main heat exchanger 1 connected to the above circuit a; a circulation circuit 2 connected to the main exchanger 1 and circulating a refrigerant gas; a compressor C connected to the circulation circuit 2; and a heat exchanger 3 for dissipating heat of the refrigerant gas to the outside.

The dissipation heat exchanger 3 is connected to a piping 4 for introduction of a primary cooling water through the piping 4. The primary cooling water is city water, industrial water cooled by a cooling tower, or the like, temperature of which varies depending on the season but is held within a range of 10 degrees Celsius to 30 degrees Celsius. A supply flow rate of the primary cooling water is controlled by a valve (not shown) to chill the refrigerant gas to a predetermined temperature.

In the chiller b designed as described above, the compressor C increases the pressure and temperature of the refrigerant gas to high levels. The refrigerant gas at high pressure and high temperatures is compressed and liquefied by the dissipation heat exchanger 3. The liquefied refrigerant is evaporated in the main heat exchanger 1 for absorbing the heat of the secondary cooling water.

The secondary cooling water reaching high temperatures by absorbing the heat of the load H can be thus chilled or cooled.

As described above, the chiller b is configured such that the secondary cooling water flowing through the chilling circuit a is chilled with the refrigerant gas. This produces the need for maintaining the temperature of the refrigerant gas below the temperature of the secondary cooling water at all times. Hence, the conventional system always allows the compressor C to operate.

Such conventional systems have a problem associated with significant energy use energy because the compressor C of the chiller b must be operated at all times.

As outside air temperature decreases in winter, the temperature of the primary cooling water decreases. Hence, with the ability of the dissipation heat exchanger 3 alone, the refrigerant gas can be decreased to a predetermined temperature.

Even in this event, however, the conventional system causes the compressor C of the chiller b to operate at all times, resulting in uselessly expending energy.

SUMMARY OF THE INVENTION

It is an object of the present invention to provide a chilling system which achieves a reduction in the amount of energy expended and also in energy loss.

A first aspect of the present invention is characterized by including a load; a chilling circuit for chilling or cooling the load with a refrigerant; a heat-dissipating mechanism for dissipating heat of the refrigerant in the chilling circuit to the outside; a refrigerant tank connected to the chilling circuit via a confluent valve; a chiller for maintaining the refrigerant stored in the refrigerant tank at a predetermined temperature; a controller for controlling the degree of valve opening of the confluent valve; and a temperature sensor for detecting a temperature of the refrigerant in the chilling circuit, and in that when the temperature sensor detects that a temperature of the refrigerant in the chilling circuit exceeds a predetermined temperature, the controller opens the confluent valve in order to mix the refrigerant in the refrigerant tank into that in the chilling circuit, and when the refrigerant stored in the refrigerant tank is maintained at a temperature within a predetermined range, the chiller stops its operation.

According to the first aspect, the chiller stops its operation as long as the refrigerant in the refrigerant tank is maintained at a predetermined temperature. For this reason, as compared with the conventional system which requires the continuous operation of the compressor of the chiller, energy is saved.

In the first aspect, a second aspect of the present invention is characterized in that the heat-dissipating mechanism is of a water cooling type and introduces industrial water or city water serving as cooling water.

According to the second aspect, industrial water or city water is used as the refrigerant for the dissipation heat exchanger. For this reason, there is not a need for using an extra power source, resulting in minimizing the expended energy.

BRIEF DESCRIPTION OF THE DRAWINGS

FIG. 3 is a circuit diagram of an example of prior art.

DETAILED DESCRIPTION OF THE PREFERRED EMBODIMENTS

Figure 1:
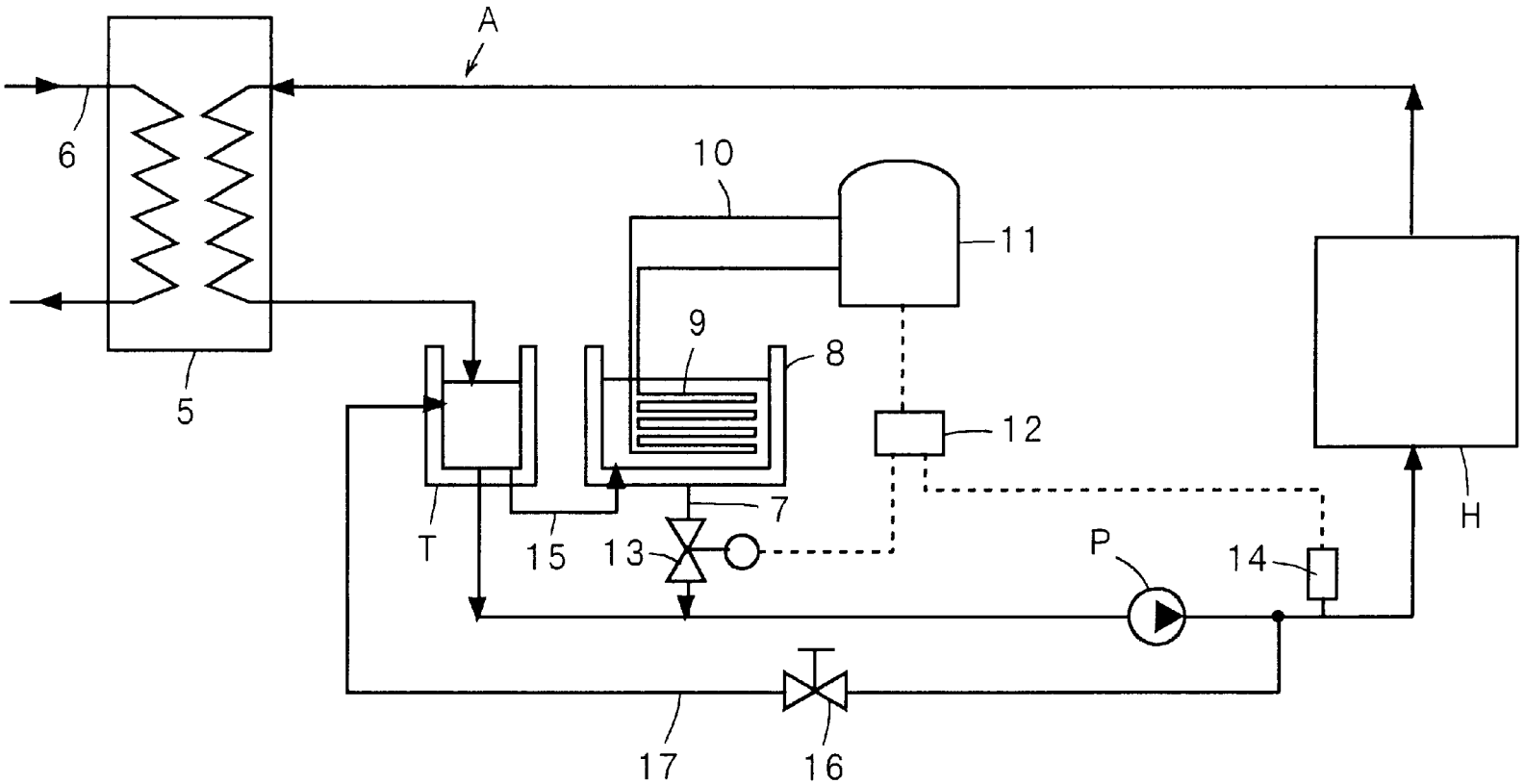
FIG. 1 is a circuit diagram of a first embodiment.

In a first embodiment illustrated in FIG. 1, a chilling circuit A is connected to a heat-producing load H.

The chilling circuit A includes a pump P for circulating secondary cooling water through the chilling circuit A, a buffer tank T for temporarily storing the secondary cooling water, and a dissipation heat exchanger 5 which corresponds to a heat-dissipating mechanism of the present invention.

The dissipation heat exchanger 5 is connected to a piping 6 for introducing a primary cooling water through the piping 6. Similar to the forgoing example of prior art, the primary cooling water is city water, industrial water or the like. The primary cooling water has a temperature difference between winter and summer, which varies in a range from 10 degrees Celsius to 30 degrees Celsius.

The secondary cooling water circulating through the chilling circuit A performs the heat exchange during a process in which the secondary cooling water flows through the load H in order to absorb the heat of the load H. The secondary cooling water having increased in temperature resulting from the absorption of the load H heat, dissipates the absorbed heat through the heat exchanger 5 to the outside. Thus, the secondary cooling water is chilled to a predetermined temperature.

The temperature of the secondary cooling water chilled by the heat exchanger 5 is determined by the temperature and flow rate of the primary cooling water fed into the heat exchanger 5. In the first embodiment, therefore, in order to chill the secondary cooling water to a predetermined temperature, a flow rate of the primary cooling water is controlled by a valve (not shown) provided in the piping 6.

The valve may be controlled either manually or automatically. In the case of automatic control, temperatures of the primary cooling water and the secondary cooling water are detected by a sensor. Based on the detected temperatures of the primary and secondary cooling waters, a controller may adjust the degree of valve opening of a servo valve (not shown).

As described above, the primary cooling water chills the secondary cooling water. Hence, the primary cooling water fed into the heat exchanger 5 stands at a temperature lower than that of the secondary cooling water to which the heat of the load H has been transferred.

The chilling circuit A is connected to a refrigerant tank 8 through a piping 7. The refrigerant tank 8 has a larger capacity than that of the buffer tank T, which stores the secondary cooling water in amounts several times more than the amount stored in the buffer tank T.

The refrigerant tank 8 incorporates an evaporator 9. The evaporator 9 is connected to a chiller 11 via a piping 10. A chilled refrigerant gas is introduced from the chiller 11 into the evaporator 9 in order to chill the secondary cooling water stored in the refrigerant tank 8 to a predetermined temperature.

The chiller 11 is provided for maintaining the secondary cooling water in the refrigerant tank 8 within a range of predetermined temperatures, and therefore only operates when needed. Specifically, in the case that a temperature of the secondary cooling water stored in the refrigerant tank 8 is set, for example, in a range of 5 degrees C. to 10 degrees C. for control, the chiller 11 stops its operation temporarily after chilling the secondary cooling water to 5 degrees C. After that, the secondary cooling water in the refrigerant tank 8 rises above 10 degrees C., whereupon the chiller 11 operates again. Then, after chilling the secondary cooling water to 5 degrees C., the chiller 11 stops again.

In other words, the chiller 11 stops its operation while a temperature inside the refrigerant tank 8 is maintained within a predetermined temperature range so as not to expend energy.

The chiller 11 designed as described above may be either of an air cooling type or of a water cooling type. In the case of the air cooling type, a fan is mounted on the chiller itself. In the case of the water cooling type, the piping 6 may be connected to a branch pipe. The primary cooling water may be introduced through the branch pipe.

The chiller 11 is connected to a controller 12 which controls the chiller 11.

The piping 7 connecting between the refrigerant tank 8 and the chilling circuit A is connected to a confluent valve 13. The degree of valve opening of the confluent valve 13 is controlled by the controller 12. Upon opening the confluent valve 13, the flow rate in accordance with the degree of valve opening causes the secondary cooling water to flow from the refrigerant tank 8 into the chilling circuit A.

As the secondary cooling water is discharged from the refrigerant tank 8 as described above, the amount of the secondary cooling water inside the refrigerant tank 8 decreases. The decreased amount is refilled from the buffer tank T via a piping 15. For this reason, a constant determined-quantity of the secondary cooling water is stored in the refrigerant tank 8 at all times.

A temperature sensor 14 is provided downstream from a pump P on the chilling circuit A. The temperature sensor 14 measures temperatures of the secondary cooling water to be applied into the load H, and applies the resulting temperature signal to the controller 12. only when the temperature signal supplied from the sensor 14 exceeds a predetermined temperature, the controller 12 opens the confluent valve 13 in order to mix the secondary cooling water stored in the refrigerant tank 8 into that flowing through the chilling circuit A.

The branch pipe 17 has an end which is connected to the chilling circuit A between the pump P and the load H, and the other end which is connected to the buffer tank T. With this configuration, when an excessive flow rate is discharged from the pump P, a redundant flow rate is returned to the buffer tank T via the branch pipe 17.

Reference numeral 16 in FIG. 1 represents a valve provided on the branch pipe 17 for adjusting the flow rate to be returned to the buffer tank T.

Next, the operation in the first embodiment will be described.

For example, when the load H is controlled at a constant temperature through the 25-degrees C. secondary cooling water, assuming that a temperature of the secondary cooling water to which the heat of the load H has transferred is 31 degrees C., the 31-degrees C. secondary cooling water is cooled by the heat exchanger 5. At this time, when a temperature of the primary cooling water introduced into the heat exchanger 5 is extremely low, e.g. 10 degrees C., it is possible for the facility of the heat exchanger 5 alone to chill the secondary cooling water from 31 degrees C. to 25 degrees C. That is to say, the heat exchanger 5 alone can provide the sufficient chilling ability.

In such an event, the controller 12 keeps the confluent valve 13 closed.

The chiller 11 stops as long as the secondary cooling water stored in the refrigerant tank 8 is maintained at a temperature of less than or equal to 10 degrees C.

Accordingly, at this time, the amount of energy expended can be reduced by the amount of energy which will be expended by the chiller 11.

On the other hand, when the primary cooling water increases in temperature as the outside air temperature rises, e.g. in summer, it is impossible for the ability of the heat exchanger 5 alone to chill the secondary cooling water in the chilling circuit A to 25 degrees C.

In this event, the controller 12 determines from the temperature information supplied from the temperature sensor 14 that a temperature of the secondary cooling water exceeds a preset temperature. Then, in response to the signal from the controller 12, the confluent valve 13 opens to allow the secondary cooling water stored in the refrigerant tank 8 to flow into the chilling circuit A.

Thus, when the secondary cooling water having chilled at 10 degrees C. or less flows from the refrigerant tank 8 into the chilling circuit A as described above, it is possible to decrease a temperature of the secondary cooling water for being supplied into the load H.

At this time, however, since the secondary cooling water in the refrigerant tank 8 has been chilled in a range from 5 degrees C. to 10 degrees C., the controller 12 determines a flow rate of the secondary cooling water to be moved into the chilling circuit A, based on the temperature of the secondary cooling water in the refrigerant tank 8 at the time of the determination and on the temperature and supply flow rate of the secondary cooling water which is being supplied into the load H. That it to say the controller 12 determines shortage of the chilling ability of the heat exchanger 5, and allows a flow rate corresponding to the shortage to flow out from the refrigerant tank 8 into the chilling circuit A. Thus, the secondary cooling water to be supplied to the load H is maintained at a temperature of 25 degrees C.

When the secondary cooling water is released from the refrigerant tank 8 into the chilling circuit A as described above, the released flow rate of the secondary cooling water is supplied from the buffer tank T into the refrigerant tank 8 via the piping 15. Upon the supply of the secondary cooling water from the buffer tank T into the refrigerant tank 8, the secondary cooling water within the refrigerant tank 8 increases in temperature.

However, the temperature of the secondary cooling water does not increase rapidly because the refrigerant tank 8 stores a large volume of the secondary cooling water maintained at a range from 5 degrees C. to 10 degrees C. Additionally, the chiller 11 stops until the temperature of the secondary cooling water exceeds 10 degrees C. Therefore, during the stopping period, the expended energy can be kept low.

The chiller 11 is actuated when the secondary cooling water in the refrigerant tank 8 exceeds 10 degrees C. Then, after the secondary cooling water in the refrigerant tank 8 is chilled to 5 degrees C., the chiller 11 stops.

As described above, according to the first embodiment, as long as the temperature of the secondary cooling water in the refrigerant tank 8 is lower than or equal to 10 degrees C., the chiller 11 stops. This achieves a lower expended energy as compared with the case in which the chiller 11 is operated at all times.

When the chilling ability of the heat exchanger 5 alone is sufficient, there is no need to release the secondary cooling water from the refrigerant tank 8 for mixing. Hence, the temperature rise of the secondary cooling water in the refrigerant tank 8 can be suppressed for a long time, resulting in minimizing energy loss.

The first embodiment is configured such that the secondary cooling water is chilled with the primary cooling water introduced into the dissipation heat exchanger 5. However, the secondary cooling water can be chilled by using a cooling fan instead of the primary cooling water. In short, the dissipation heat exchanger 5 may be of an air cooling type.

However, if the heat exchanger 5 is of a water cooling type as described in the first example, industrial water, city water or the like can be used for the primary cooling water, resulting in lower expended energy in comparison with the case of operating the cooling fan.

The first embodiment uses gas as a refrigerant for the chiller 11, but liquid may be used.

Figure 2:
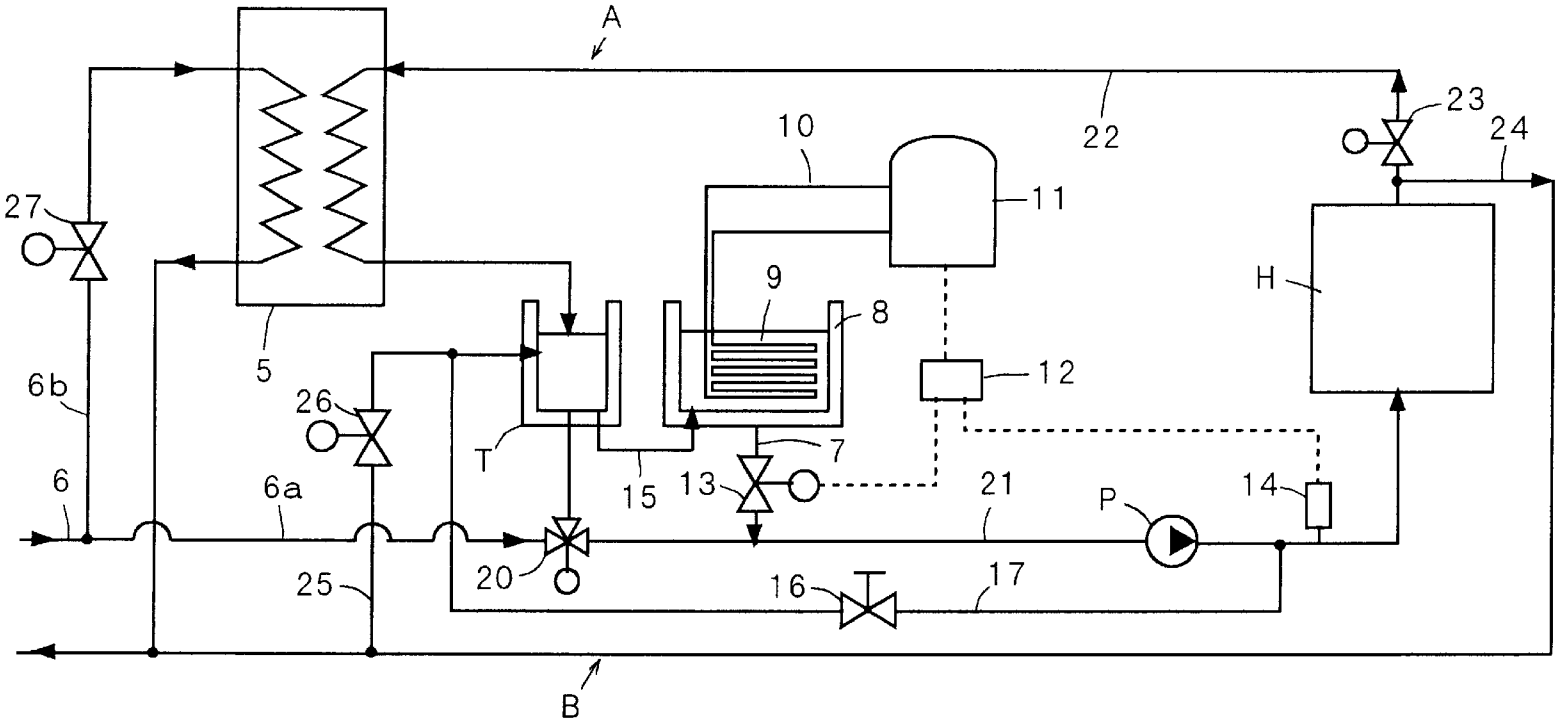
FIG. 2 is a circuit diagram of a second embodiment.

A second embodiment illustrated in FIG. 2 is configured such that primary cooling water is introduced directly into a load H when the primary cooling water is maintained at a constant temperature, alternatively when the primary cooling water is of good quality. Specifically, a piping 6*a* is branched from the piping 6 introducing the primary cooling water. The piping 6*a* is connected to a piping 21 which makes the connection between the buffer tank T and the pump P through a three-way valve 20.

A valve 23 is connected to the middle of a piping 22 making the connection between the load H and the dissipation heat exchanger 5. A return piping 24 is branched upstream from the valve 23 and is connected with the return flow of the primary cooling water.

The return piping 24 is connected to a supplementary feed piping so as to be connected with the buffer tank T via the piping 25. The supplementary feed piping is provided with a valve 26 of which the degree of valve opening is controlled by the controller 12.

Another valve 27 is provided in the piping 6*b* introducing the primary cooling water into the heat exchanger 5.

Next, the operation in the second embodiment will be described.

The valves 23, 26 and 27 are closed, and the three-way valve 20 is switched to a position of interrupting the communication between the buffer tank T and the pump P in order to allow the communication between the branched piping 6*a* and the pump P.

With this configuration, the primary cooling water is introduced directly into the load H from the piping 6 via the branched pipe 6*a*, three-way valve 20, piping 21 and pump P in sequence. The primary cooling water introduced into the load H is discharged into the return flow of the primary cooling water via the return piping 24.

A circuit B for guiding the primary cooling water is thus configured, which is a chilling circuit of the present invention.

By thus directly introducing the primary cooling water to the load H, it is possible to use the primary cooling water for transferring the heat of the load H. Accordingly, if the supply rate of the primary cooling water is controlled, the load H can be controlled at a constant temperature.

However, when the primary cooling water is high in temperature, a sufficient chilling ability cannot be obtained only by supplying the primary cooling water. When the primary cooling water introduced from the piping 6 has variations in temperature, a stable temperature control is impossible.

In the event as described above, the confluent valve 13 is opened to mix the secondary cooling water stored in the refrigerant tank 8. By mixing with the secondary cooing water, the shortage of the chilling ability can be compensated. Further, the variations in temperature of the primary cooling water are stabilized.

As in the first embodiment, the chiller 11 for chilling the secondary cooling water in the refrigerant tank 8 is operated only when the secondary cooling water raises higher than or equal to the predetermined temperature.

The secondary cooling water stored in the refrigerant tank 8 flows out as described above. This lowers the water level in the buffer tank T for replenishing the refrigerant tank 8 with the secondary cooling water. The water level in the buffer tank T is detected by a sensor (not shown) connected to the controller 12. When the water level of the secondary cooling water in the buffer tank T is below a predetermined level, the controller 12 opens the valve 26 based on the signal supplied from the sensor. By opening the valve 26, the flow rate of the secondary cooling water released from the refrigerant tank 8 can be supplemented.

In the second embodiment, the primary cooling water has the same properties as those of the secondary cooling water because the secondary cooling water is mixed with the primary cooling water.

EXPLANATION OF CODES

H LOAD
A, B CHILLING CIRCUIT
5 DISSIPATING HEAT EXCHANGER CORRESPONDING TO HEAT-DISSIPATING MECHANISM OF THE PRESENT INVENTION
8 REFRIGERANT TANK
11 CHILLER
12 CONTROLLER
13 CONFLUENT VALVE
14 TEMPERATURE SENSOR

I claim:

1. A chilling system comprising:

a load;

a chilling circuit for chilling the load with a refrigerant;

a heat-dissipating mechanism for dissipating heat of the refrigerant in the chilling circuit to the outside;

a refrigerant tank connected to said chilling circuit via a confluent valve;

a chiller for maintaining the refrigerant stored in said refrigerant tank at a predetermined temperature;

a controller for controlling the degree of valve opening of said confluent valve; and a temperature sensor for detecting a temperature of the refrigerant in said chilling circuit, wherein when said temperature sensor detects that a temperature of the refrigerant in said chilling circuit exceeds a predetermined temperature, said controller opens said confluent valve in order to mix the refrigerant in said refrigerant tank with that in said chilling circuit, and when the refrigerant stored in said refrigerant tank is maintained at a temperature within a predetermined range, said chiller stops its operation.

2. The chilling system according to claim 1, wherein said heat-dissipating mechanism is of a water cooling type and introduces industrial water or city water serving as cooling water.

* * * * *